United States Patent [19]

Delia

[11] 3,990,577

[45] Nov. 9, 1976

[54] PROTECTIVE, COLOR INDICATING COSMETIC STICK CASE

[75] Inventor: Anthony D. Delia, West Redding, Conn.

[73] Assignee: Clairol Incorporated, New York, N.Y.

[22] Filed: Feb. 11, 1976

[21] Appl. No.: 657,334

[52] U.S. Cl. ..... 206/457; 206/45.34; 206/459; 40/126 R; 220/23; 401/78

[51] Int. Cl.[2] ..... B65D 1/24; B65D 83/00

[58] Field of Search ..... 206/457, 459, 45.34; 40/126 R; 401/194, 78; 220/23, 376

[56] References Cited

UNITED STATES PATENTS

| | | | |
|---|---|---|---|
| 1,968,915 | 8/1934 | Shaw | 40/126 R |
| 2,595,403 | 5/1952 | Neuschaefer | 401/194 |
| 2,689,060 | 9/1954 | Katzman | 220/376 |
| 2,895,834 | 7/1959 | Brav | 40/126 R |
| 3,085,709 | 4/1963 | Klein | 220/23 |
| 3,370,697 | 2/1968 | Levey et al. | 206/45.34 |
| 3,706,354 | 12/1972 | Gruska | 401/78 |

*Primary Examiner*—William T. Dixson, Jr.
*Attorney, Agent, or Firm*—Irving Holtzman; George A. Mentis; David J. Mugford

[57] ABSTRACT

A circular tubular cap and dummy cosmetic stick assembly in which the cap is transparent near the top and opaque near the bottom. The dummy cosmetic stick (e.g. lipstick) is maintained in place in the cap near its top by means of upwardly extending flexible tabs which form part of a tray that forms the base of the dummy cosmetic stick.

3 Claims, 5 Drawing Figures

PROTECTIVE, COLOR INDICATING COSMETIC STICK CASE

This invention relates to a protective cosmetic stick case. More particularly, it concerns a lipstick case designed to protect the lipstick contained in the case and at the same time to visually indicate the color of said lipstick.

It is known in the prior art to provide lipstick cases; some of which serve to protect the lipstick contained therein from deterioration by exposure to light and some of which have some means for visually indicating the color of the lipstick contained therein. In this connection, attention is directed to U.S. Pat. Nos. 2,595,403; 2,338,812; 3,088,585; 3,050,212; 3,338,458; 3,869,043 and 3,762,545. These devices, however, have several disadvantages; the chief among them being the difficulty of assembly or the inadequacy of the protection that they offer for the lipstick.

It is also known in the prior art to provide a lipstick case having a tubular cover that is generally rectangular in cross-section. This cover is provided at its closed end with a transparent section through which a dummy lipstick is visible. This dummy lipstick is removably inserted into the cover through its open end and consists of a hollow bullet portion mounted on a tray portion that is also rectangular in configuration.

For aesthetic purposes, it is often desirable to fabricate the cover of the lipstick case so that it is circular in cross-section. When this was done and an effort is made to modify the lipstick dummy of the prior art to accommodate this circular construction, problems were encountered in assembling these pieces. Thus, it was found that when the lipstick dummies were inserted in the cover, stresses were created in the cover causing the cracking or crazing of the cover. It has now been found that these disadvantages can be avoided if the dummy lipstick is constructed as described in more detail below.

It is accordingly an object of the present invention to provide a cosmetic stick case assembly, especially a lipstick case assembly provided with a dummy stick, that is easy to assemble without causing cracking or crazing of the cover of said case.

Other and more detailed objects of this invention will be apparent from the following description, claims and drawings wherein:

Figure 1:
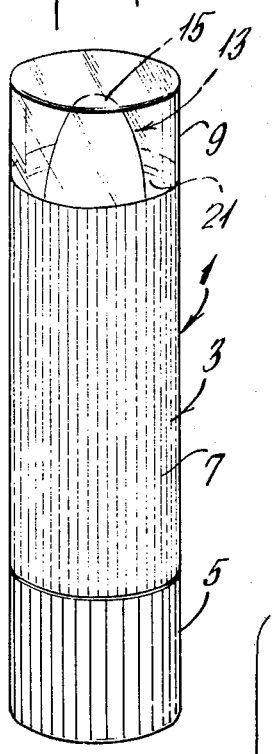
FIG. 1 is a perspective view of a lipstick case embodied in the present invention.

Referring now to the drawings wherein the same numerals designate the same structure in the various views, the lipstick case is shown generally at 1 and comprises a cap 3 and a body portion 5. Body portion 5 is a conventional structure that houses the lipstick, not shown, and the means for moving the lipstick out of the housing and forms no essential part of the present invention.

Cap 3 is tubular in construction, circular in cross-section and is provided with lower opaque section 7 and an upper transparent section 9 through which a dummy lipstick 13 may be viewed. On its inner surface, cap 3 has a stop 11 that extends around the inner surface of cap 3. This stop serves to limit the upward movement of dummy lipstick 13 when the latter is inserted in cap 3 as described in more detail below.

Figure 2:
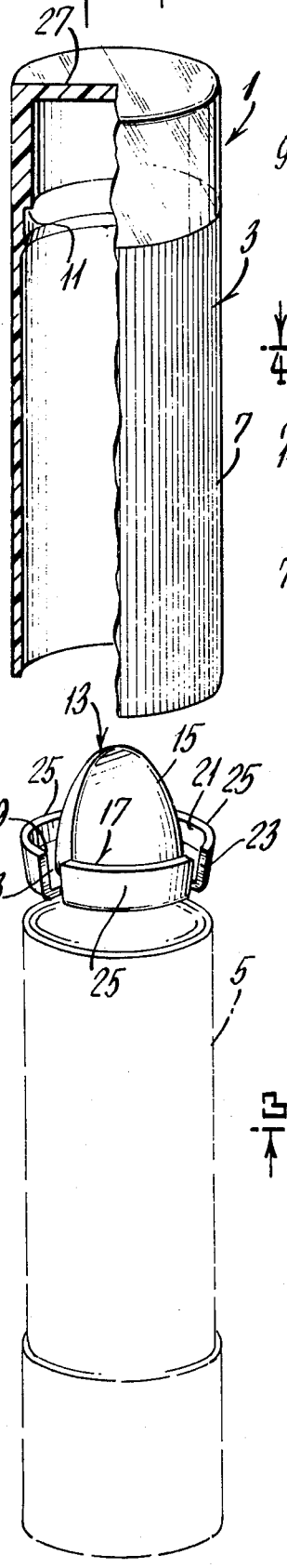
FIG. 2 is an enlarged, exploded view of the lipstick case shown in FIG. 1, part of the cap being cut away to show the details of the interior of the cap.
Figure 3:
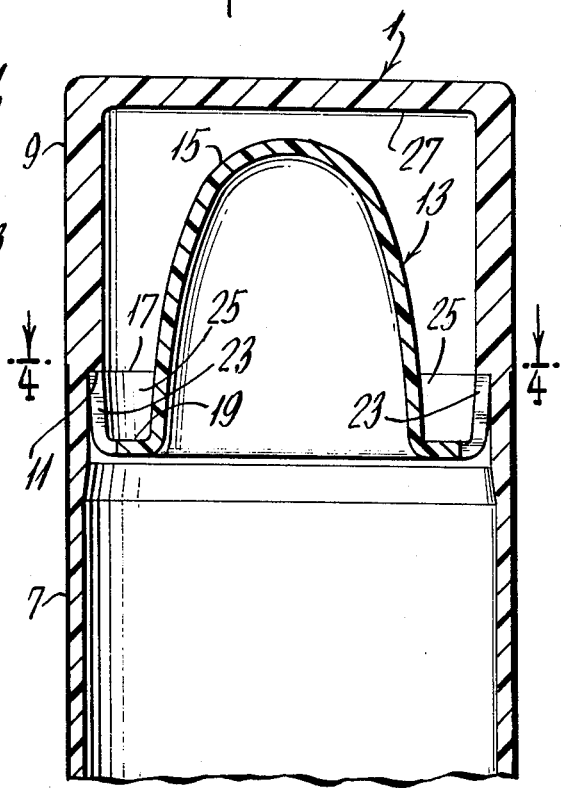
FIG. 3 is an enlarged, partial longitudinal sectional view through the lipstick case shown in FIG. 1 showing the details of the dummy lipstick and its relationship to the cover of the lipstick case.
Figure 4:
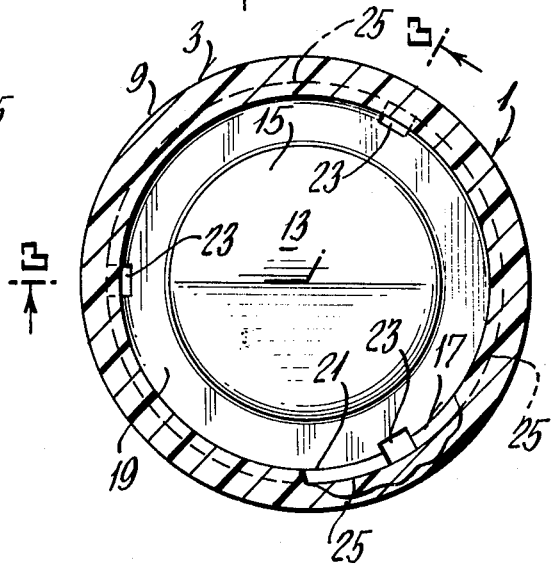
FIG. 4 is a cross-sectional view of the lipstick case shown in FIG. 3 taken along line 4—4.

Dummy lipstick 13 comprises a hollow bullet portion 15 and an annular tray portion 17. Annular tray portion 17 comprises a horizontally extending base 19 and an upwardly extendng skirt 21. At intervals, around the circumference of annular tray portion 17, portions of the tray are cut away to form notches 23. These are cut through the full height of skirt 21 as best seen in FIG. 2 and part way through the depth of base 19 as best seen in FIG. 4. This provides a plurality of flexible spring tabs 25 that are compressible inwardly as described in more detail below.

Dummy lipstick 13 is preferably molded as a single piece of a flexible synthetic plastic material e.g. styrene. Since the dummy lipstick will serve as a visual indication of the color of the lipstick contained in the case, it will be colored appropriately.

In assembling the present lipstick case, dummy lipstick 13 is inserted in the open end of cap 3 with the point of the bullet directed toward the roof 27 of cap 3. Dummy lipstick 13 is then pushed upwardly toward roof 27 until the upper margin of skirt 21 reaches stop 11. The outer diameter of skirt 21 is somewhat larger than the internal diameter of cap 3. As a consequence, when dummy lipstick 13 is pushed home, spring tabs 25 are compressed inwardly. This spring action serves to maintain dummy lipstick 13 in position in cap 3.

Figure 5:
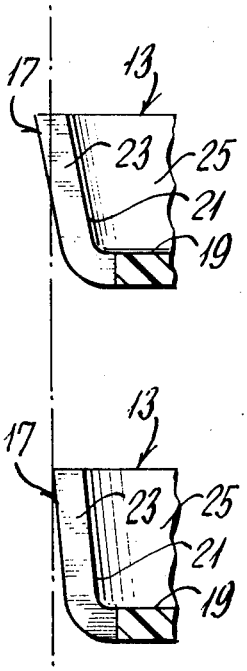
FIG. 5 is a partial cross-sectional view of the spring tab associated with the dummy lipstick, the tab being shown above in its relaxed position and below in its compressed position.

This action is shown in FIG. 5. The upper view shows the spring tab 25 in the relaxed position before the dummy lipstick 13 is pushed into position. The lower view shows spring tab 25 in compressed condition. This will be the position of tab 25 when it is pushed into place within cap 3.

Aside from serving as a visual indication of the color of the lipstick in the case, dummy lipstick 13 also acts to protect the lipstick contained in the case from being degraded by exposure to sunlight. Together with opaque section 7 of cap 3, dummy lipstick 13 shields the lipstick contained in the case 1 from the harmful effects of light.

The device of the present invention offers many advantages both from an operating point of view and from a manufacturing point of view. Some of these advantages are listed below:

1. The present spring tab concept creates the real lipstick image cover with only two parts which is an advantage over the most complicated prior art devices.

2. With the present invention, both the dummy lipstick part and the clear cover part can be fabricated with relatively simple molds. It has no design features which require special tooling or specialized molding techniques.

3. No adhesive or welding is necessary to join the two parts with this system.

4. Assembly of the dummy lipstick into the cover is a simple press fit.

5. The present spring tab concept is tolerant of a wide dimensional interference range. Tests show that its retention is acceptable between an interference range of 0.002 to 0.012 inch. This advantage gives the molders of these components comfortable operating limits.

6. As noted above, the nature of the dummy and cover engagement with the spring tab concept creates no stress conditions which would render cracking or crazing of the cover when the cover is fabricated of conventional plastics (e.g. styrenes).

7. By virtue of 6 above, the spring tab concept allows the use of relatively low cost, readily molded, conventional types of plastics for the cover. There are plastics which would not be stress crack prone but other aspects of such plastics effecting costs and/or aesthetics would become detracting factors.

8. The spring tab concept has proven to maintain good dummy-in-cover retention properties for a long period of time over the 0.010 inch interference range.

9. The spring tab concept of this invention employs relatively large surface-to-surface contact points thereby taking advantage of surface friction to aid retention.

What is claimed is:

1. A tubular cap and dummy cosmetic stick assembly adapted to served as a protective cover in a cosmetic stick case and to give a visual indication of the cosmetic contents of said case; said tubular cap being cylindrical in shape, circular in cross-section and being provided at its upper end with a roof; said cap also being transparent near its upper end and opaque at its lower end; stop means disposed on the internal surface of said cap adapted to limit the upward motion of a dummy cosmetic stick that is inserted into said cap; a dummy cosmetic stick simulating the contents of said case disposed inside said cap near its upper transparent end, said dummy stick being provided at the lower end thereof with a circular annular tray having upwardly extending flexible tabs adapted to be compressed inwardly when said dummy stick is inserted into said cap to retain said dummy stick in said cap, the upper margin of said flexible tabs being in engagement with said stop means.

2. A tubular cap and dummy cosmetic stick assembly according to claim 1 in which the dummy cosmetic stick has the form of a lipstick which is colored to simulate the color of the lipstick contained in the case.

3. A tubular cap and dummy cosmetic stick assembly according to claim 2 in which the circular annular tray of said dummy lipstick comprises a base portion extending outwardly from the lipstick shape adjacent the bottom thereof and said flexible tabs extend upwardly from said base portion, the upper margins of said tabs forming an interrupted circle whose outer diameter is greater than the inner diameter of said cap.

* * * * *